United States Patent [19]

Summerlin

[11] 4,074,554

[45] Feb. 21, 1978

[54] FASTENER PLACING APPARATUS

[75] Inventor: Frederick Arthur Summerlin, Wheathampstead, England

[73] Assignee: Aerpat A.G., Zug, Switzerland

[21] Appl. No.: 749,177

[22] Filed: Dec. 9, 1976

Related U.S. Application Data

[63] Continuation-in-part of Ser. No. 662,873, March 1, 1976, abandoned, which is a continuation of Ser. No. 454,817, March 26, 1974, abandoned.

[30] Foreign Application Priority Data

Mar. 29, 1973 United Kingdom ..... 15238/73

[51] Int. Cl.[2] ..... B21J 15/34

[52] U.S. Cl. ..... 72/114; 72/391

[58] Field of Search ..... 72/114, 391; 85/70, 85/71; 29/243, 53

[56] References Cited

U.S. PATENT DOCUMENTS

| | | | |
|---|---|---|---|
| 2,283,708 | 5/1942 | Trautmann | 72/114 |
| 2,402,303 | 6/1946 | Stone | 72/114 |
| 2,753,072 | 7/1956 | Mitchell | 72/391 |
| 3,197,987 | 8/1965 | Martin | 72/114 |
| 3,574,915 | 4/1971 | Jeal | 72/391 |
| 3,587,271 | 6/1971 | Rigot | 72/114 |
| 3,654,792 | 4/1972 | Mead | 72/391 |
| 3,659,449 | 5/1972 | Abernathy | 72/391 |
| 3,861,014 | 1/1975 | Summerlin | 72/114 |

*Primary Examiner*—C.W. Lanham
*Assistant Examiner*—Gene P. Crosby
*Attorney, Agent, or Firm*—Oblon, Fisher, Spivak, McClelland & Maier

[57] ABSTRACT

A tool for placing fasteners of the kind having a threaded first part which is pulled towards and/or into a second part to place the fastener without the need to accurately align the tool with the fastener, comprises a tubular nosepiece providing an annular abutment face for abutting the second part of the fastener and a mandrel which extends through the nosepiece and has a threaded part which projects forwardly of the abutment face for threadedly engaging the first part of the fastener. A draw bar which is rotatable and reciprocable on the tool axis which extends through the annular abutment face at right angles thereto transmits rotary and reciprocating motion to the mandrel through a universal joint whereby the mandrel is given freedom to move pivotally out of alignment with the tool axis. A tube surrounds part of the mandrel and limits the freedom of movement of the mandrel, and is movable along the tool axis. In one embodiment the tube is reciprocated and rotated with the mandrel and in another embodiment, the tube is not obliged to rotate or reciprocate with the mandrel. The tube projects forwardly of the abutment face when at the forward end of its reciprocation and engages the fastener and assists correction of alignment of the tool and prevents inward collapse of the fastener.

8 Claims, 5 Drawing Figures

FASTENER PLACING APPARATUS

CROSS-REFERENCE TO RELATED APPLICATIONS

This application is a continuation-in-part of application Ser. No. 662,873 filed Mar. 1, 1976, now abandoned, which in turn is a continuation of application Ser. No. 454,817 filed Mar. 26, 1974 and now abandoned.

BACKGROUND OF THE INVENTION

The invention relates to fastener placing apparatus for placing fasteners of the type comprising a threaded first part which is pulled towards and/or into a second part to place the fastener. Such fastener placing apparatus comprises an abutment for abutting the second part of a fastener to be placed, and a threaded member for engaging with the threaded first part of the fastener, the threaded member being rotatable and reciprocable with respect to the abutment. Such apparatus is hereinafter referred to as "fastener placing apparatus of the type defined," and one form is described in detail in my U.S. Pat. No. 3,861,014. It has been found that, in such tools in which the threaded mandrel has no permissible movement sideways from alignment with the tool axis, the rate of breakage of mandrels in use of the tool is unexceptably high, due to initial mis-alignment of the tool causing too much sideways bending stress on the mandrel. It is an object of this invention to reduce the breakage rate of mandrels consequent upon initial mis-alignment of the tool.

SUMMARY OF THE INVENTION

The invention provides, in one of its aspects, apparatus for placing a fastener by pulling a threaded first part of the fastener towards and/or into a second part of the fastener, which apparatus comprises abutment means having an abutment face for abutting the second part of the fastener and defining a tool axis at right angles to said abutment face, a threaded mandrel for threadedly engaging the first part of the fastener, and a tubular auxiliary member coaxial with said tool axis and surrounding said mandrel with clearance, said auxiliary member being reciprocable along said tool axis relative to said abutment means and projecting forwardly of said abutment means when at the forward end of its reciprocation, said mandrel being reciprocable and rotatable and having limited freedom to move out of alignment with said tool axis, said freedom to move being limited by the auxiliary member.

Preferable the auxiliary member is arranged to prevent contact of the threaded member with the abutment, at least while the threaded member is rotating.

The auxiliary member may be in the form of a sleeve or other tube-like member surrounding part of the threaded member. The auxiliary member may be interposed between the threaded member and the abutment member. The arrangement is such that, in use of the apparatus to place a fastener, the auxiliary member also engages the fastener and such engagement may assist in preventing undesired deformation or collapse of the fastener.

BRIEF DESCRIPTION OF THE DRAWINGS

Embodiments of the invention will now be described by way of example and with reference to the accompanying drawings, in which.

DETAILED DESCRIPTION OF PREFERRED EMBODIMENTS

Figure 1:
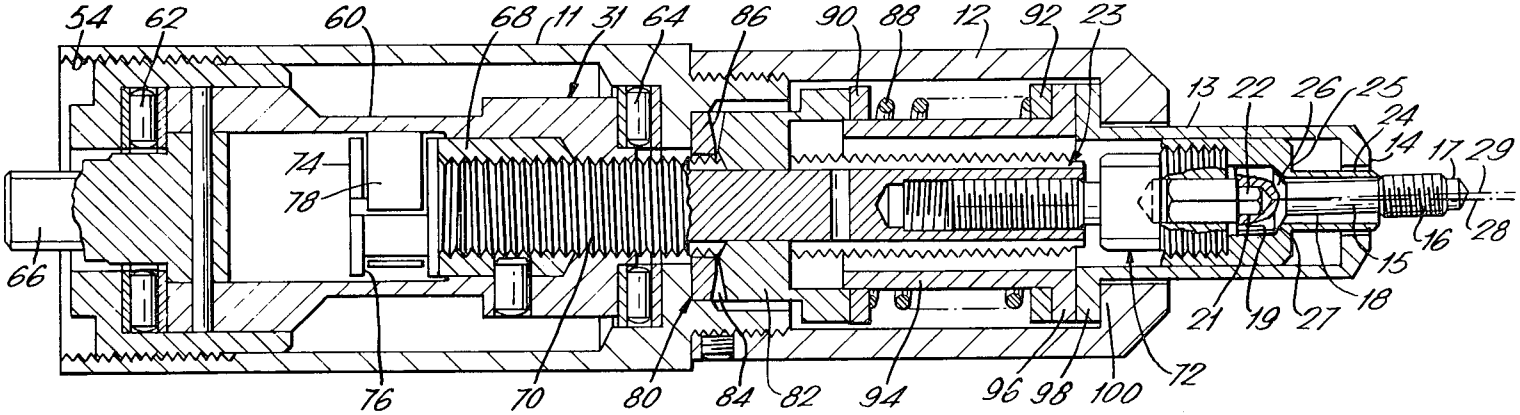
FIG. 1 is a longitudinal axial section through a fastener placing tool.

The fastener placing tool of this example comprises a generally cylindrical body 11 to one end of which (the forward end) is secured a tubular extension 12. A generally tubular nose-piece 13 projects forwardly from the extension 12, and is substantially closed at its forward end by an annular end wall which provides an annular abutment face 14 for engaging with the second part of a fastener to be placed by the tool. The abutment face 14 constitutes the abutment hereinbefore referred to. The threaded member previously referred to is provided by a mandrel 15. The mandrel comprises an elongate stem which extends forwardly through the annular end wall of the nosepiece, and a radially enlarged head 19 at the rearward end of the stem. The stem has an externally threaded part 16 adjacent to the forward end and an unthreaded part 18 between the head 19 and the threaded part 16. Forwardly of the threaded part 16 is an unthreaded probe portion 17 which is tapered at its extreme forward end and assists in engaging the mandrel in a fastener. The probe portion 17 and the unthreaded part 18 of the stem have reduced diameters compared with the diameter of the threaded part 16, their diameters being approximately equal to the root diameter of the threaded part 16. The threaded part 16 is adapted to threadedly engage the threaded first portion of a fastener. The head 19 of the mandrel has a hexagonal socket 21 in its rear end face. This hexagonal socket is a slack fit on a hexagonal key 22 which is secured in a hexagonal socket in the front end of a rotatable and reciprocable drawbar 23 located inside the extension 12 and the front end of the body 11. The key 22 provides a rotary driving connection between the drawbar and the mandrel.

The auxiliary member is provided by a tube 24 which surrounds the unthreaded part 18 of the mandrel stem. In this embodiment the tube 24 is integral with a hollow boss 25 which is secured to the front end of the drawbar 23 and holds the mandrel and key in driven engagement with the drawbar. The head 19 of the mandrel is joined to the exterior of the unthreaded portion 18 through a conically tapering face 26 which seats against a complementary conical face 27 within the boss 25. The drawbar 23, the boss 25 and the tube 24 are rotatable together about the longitudinal axis 28 of the tool body. The annular abutment face 14 is perpendicular to and concentric with this tool axis 28. The slack fit of the mandrel head 19 within the boss 25 and of the mandrel hexagonal socket 21 on the hexagonal key 22 allow the mandrel to move out of alignment with the drawbar, pivoting about a position located at the hexagonal key and socket, within the limits imposed by the clearance between the inside of the tube 24 and the exterior of the unthreaded portion 18 of the mandrel. The maximum angular misalignment possible between the mandrel axis 29 and the tool axis 28 is about 3°.

Figure 5:
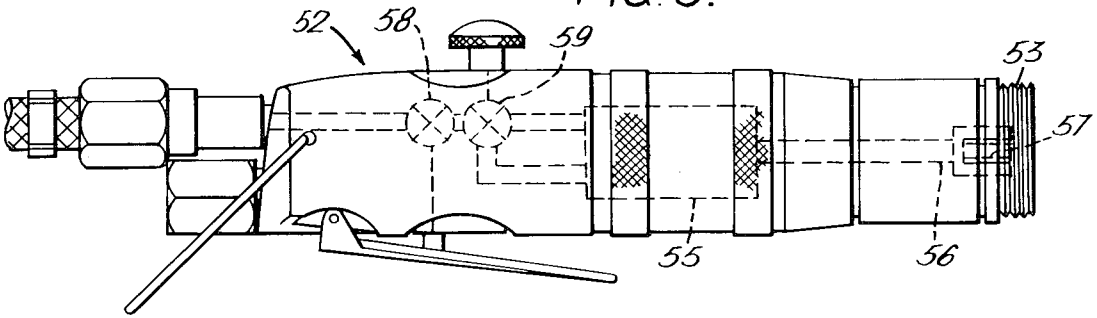
FIG. 5 shows, on a reduced scale, a reversible rotary air motor unit for use in driving the placing tools.

The placing tool is driven by an air motor unit 52 of conventional kind shown in FIG. 5. The air motor unit 52 is secured to the rear end of the cylindrical body 11 of the placing tool by engagement of a male screw thread 53 on the motor unit with a complementary screw thread 54 in the rear end of the body 11. The motor unit contains a reversible rotary air motor 55 which is supplied with compressed air via an air line, and has an output member 56 which is rotated by the air motor and provides a rotary drive for the placing tool. The output member has a hexagonal socket 57 for receiving a complementary hexagonal key to be rotated. The motor unit includes an on/off valve 58 and a reversing valve 59 each with appropriate manual controls, whereby the operation of the air motor can be controlled.

The placing tool body contains a lead-screw device indicated generally at 31 whereby the rotary drive imparted by the motor unit is either transmitted to rotate the drawbar 23 or is translated into reciprocatory movement of the drawbar 23, as will become apparent. As the mandrel 15 is held in driven engagement with the drawbar, the mandrel executes rotatory and reciprocatory movements corresponding to those of the drawbar.

The leadscrew device 31 comprises a generally tubular nut housing 60 which is mounted for rotation about the tool axis between two thrust bearings 62, 64. A hexagonal key 66 which is able to engage in the output member 56 of the motor unit, to be rotated thereby, is pinned in the bore of the nut housing 60 and projects rearwardly of the body 11.

An internally screw threaded nut 68 is pinned within the bore of the nut housing adjacent to the forward end thereof so as to be rotatable with the nut housing at a fixed position on the tool axis.

The drawbar 23 is in two sections and comprises an elongate bolt 70 and a socket adaptor 72. The bolt 70 is externally threaded and extends through the nut 68 in threaded engagement therewith and forwardly into the body extension 12. The rear end of the bolt is formed with an enlarged bolt head 74 having a peripheral groove 76 in which is seated a nearly circular bandspring 78. One end of the bandspring is keyed to the bolt head and the other end is free.

The bandspring 78 is not rotatable relative to the bolt head. The bandspring is resiliently compressed radially inwardly by the surrounding nut housing 60 so that it resiliently expands into engagement with the internal surface of the nut housing. According to the direction of any relative rotation between the nut housing 60 and the bolt 70, the bandspring will assume either a leading condition in which it tends to expand and transmit a large frictional force (that is to say, a high torque) between the nut housing and the bolt, or a trailing condition in which it will transmit a lesser torque than in the leading condition. When the tool is to be used for placing fasteners having a right-hand thread, the bandspring is arranged to transmit the greater torque in a clockwise sense as viewed from the left hand end in the drawings, and conversely, when the fastener has a left hand thread, the bandspring is arranged to transmit the greater torque in the anticlockwise sense.

By reason of the frictional engagement provided between the nut housing and the bandspring, the bandspring provides a torque limiting rotary connection between the nut housing and the drawbar and the connection is assymmetric in the sense that it will transmit a greater torque in one sense of rotation than in the opposite sense.

The bandspring 78 is not always essential since the function of providing a torque limiting rotary connection having an assymetric characteristic which it performs can be performed by frictional engagement of the bolt head 74 against the nut 68 at the appropriate time, provided that a second torque limiting rotary connection which is necessarily provided is endowed with an assymmetric characteristic. Thus, when the bolt head 74 moves fully forwardly into engagement with the nut 68 it tends to jam into frictional engagement with the nut so that when the direction of rotation of the nut is reversed a certain finite torque is required to separate the bolt head from the nut. Thus a torque up to this amount can be transmitted from the nut to the drawbar and the bandspring then serves only to duplicate the torque limiting rotary connection between the head 74 and the nut 68 as a fail safe measure.

The socket adaptor 72 is secured to the forward end of the bolt 70, being threadedly engaged and pinned therein, so that the adaptor 72 and bolt are rotatable and reciprocable as a unit. The socket adaptor 72 provides a hexagonal socket in which is engaged the hexagonal key 22 so that the mandrel 15 is keyed for rotation with the drawbar. The socket adaptor 72 also receives the hollow boss 25 whereby the mandrel is held captive to the drawbar so as to reciprocate with the drawbar.

A second torque limiting rotary connection in the form of a slipping clutch 80 having an assymmetric characteristic to enable omission of the bandspring is provided between the drawbar and the tool body 11. The clutch 80 comprises a movable clutch member 82 which is keyed to the bolt 70 of the drawbar for rotation therewith and so as to be movable axially relative to the drawbar.

The movable member 82 is formed with a rearwardly facing ring of teeth 84 each having two faces which slope in mutually opposite directions of rotation of the ring and which are engageable with similarly sloping faces of a complementary ring of teeth 86 formed on a forwardly facing end surface of the body 11. The movable member 82 is permanently urged rearwardly by a helical spring 88 so that its teeth interengage those of the body 11 which constitutes a fixed member of the clutch.

The two oppositely directed faces of each tooth of the two rings of teeth slope at different angles, all of the more steeply sloping faces of each set being directed in the same sense of rotation and engaging the steeply sloping faces of the teeth of the other ring. Thus the slipping clutch 80 also has assymmetric torque transmitting characteristics and is arranged so that, for placing right hand threaded fasteners, a greater torque can be transmitted from the drawbar to the body in a clockwise direction and conversely for left-handed threaded fasteners.

The spring 88 is supported between washers 90, 92 on a sleeve 94 which has an external flange 96 at its forward end. The rearward end of the nosepiece 13 has an external flange 98 disposed between the flange 96 and an inwardly directed flange 100 at the forward end of the extension 12. The nosepiece 13 and the sleeve 94 are able to move rearwardly relative to the extension 12 from the position shown in FIG. 1 to the position shown in FIG. 3 and in doing so compress the spring 88 so that the movable member 82 of the clutch is pressed more strongly into engagement with the fixed member, thereby increasing the torque transmissible by the slipping clutch in both directions of rotation. However, when the nosepiece is in its fully forward position, as shown in FIG. 1, the pressure exerted by the spring 88 is sufficient to keep the clutch members lightly engaged so that a low torque can be transmitted by the clutch. When this low torque is then exceeded the mutually engaging sloping faces of the two clutch members ride up each other, causing the movable member to move axially forwardly against the urging of the spring until the teeth of the movable member ride over those of the fixed member thus causing relative rotation between the two clutch members.

The operation of the lead screw device whereby the mandrel can be rotated and reciprocated will now be described in relation to a fastener having a right hand thread.

Initially, as shown in FIG. 1, the nosepiece 13 is in its forward position, the slipping clutch members being lightly engaged, and the drawbar 23 is fully forward with the bolt head 74 jammed against or at least abutting the nut 68.

The air motor is actuated to rotate the nut housing 60 and with it the nut 68 in a clockwise direction. Friction between the bolt head 74 and the nut 68, aided by that between the nut housing 60 and the bandspring causes the drawbar to rotate so that the movable clutch member 82 rotates relative to the fixed member, i.e., the body 11, and the mandrel 15 is rotated.

The tool is offered up to a fastener 32 (shown in FIG. 2) so that the rotating mandrel is entered into threaded engagement with the fastener. As the mandrel advances into the fastener, so the relatively rearwardly moving fastener comes into abutment with the nosepiece 13 moving it rearwardly and thus increasing the force exerted by the spring 88 on the movable clutch member 82. Eventually the slipping clutch 80 is able to transmit more torque than both the bandspring and the friction between the bolt head and the nut, with the result that the drawbar is prevented from rotating. However, the nut continues to rotate and as a consequence the non-rotating drawbar moves axially rearwardly thereby placing the fastener as will be explained in greater detail below.

Once the fastener is fully placed the direction of rotation of the motor is reversed, so that the nut rotates in the opposite sense. The nosepiece is still at its rearward position so that the slipping clutch is still preventing rotation of the drawbar relative to the body and therefore the drawbar moves axially forwards until the bolt head again strikes the nut, and in this process the nosepiece is permitted to move forwardly with the fastener also so that the spring pressure on the movable clutch member decreases. Once the bolt head 74 strikes the nut, the slipping clutch is overtorqued and slips so that the drawbolt again rotates, this time in the anticlockwise sense, and thus disengages the mandrel from the fastener.

Figure 2:
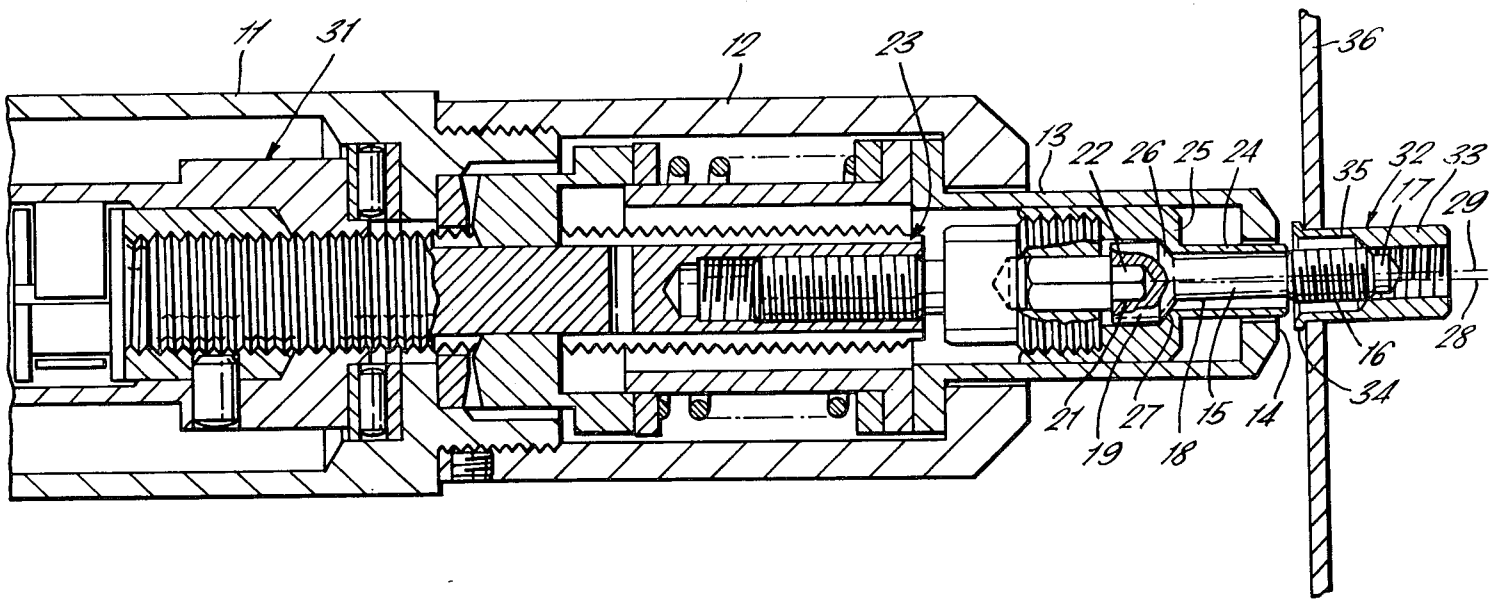
FIG. 2 shows the tool with the threaded member in the initial stage of engagement with a misaligned fastener.
Figure 3:
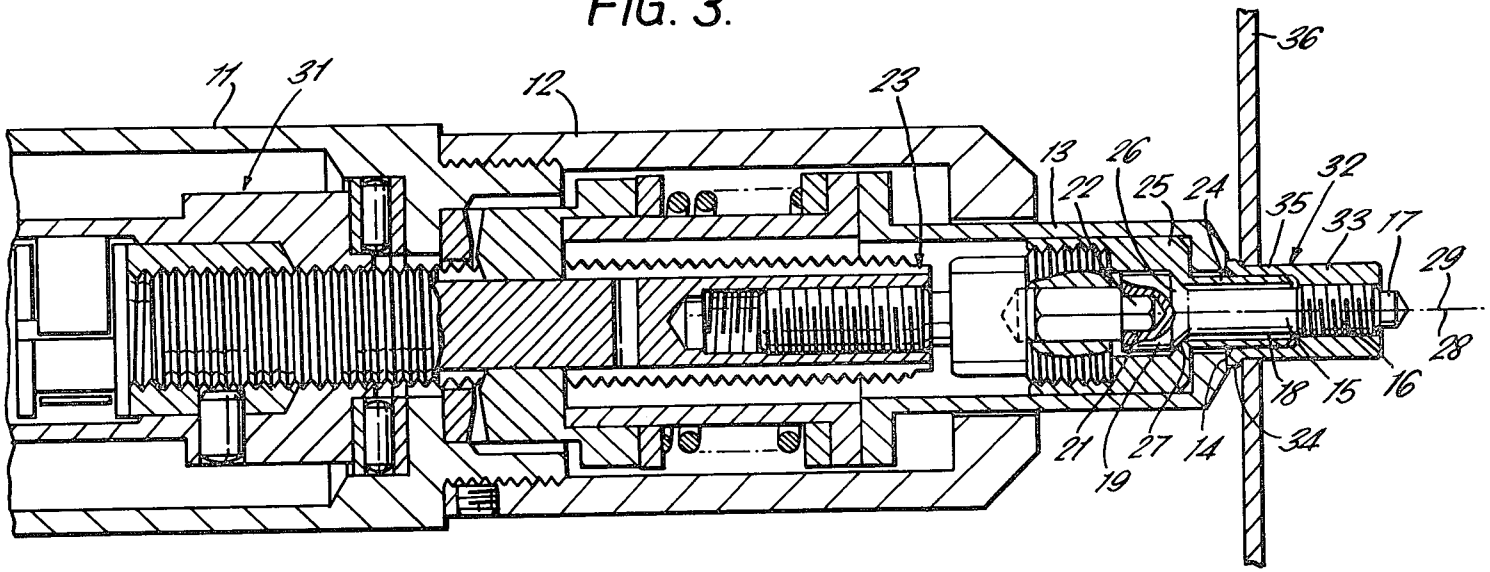
FIG. 3 shows the tool and fastener in complete engagement and in alignment with each other.

The fastener 32 is generally tubular and comprises an internally threaded first part 33 formed integrally with a second part having an unthreaded tubular intermediate portion 35 and an outwardly extending head flange 34 which is joined to the first part by the tubular intermediate portion 35. The fastener is inserted, with the threaded first part leading, into a suitably sized aperture in a panel 36 until the flange 34 abuts the near face of the panel. The method of using the tool to place the fastener is generally that the operator actuates the tool to rotate the mandrel in a clockwise direction and offers the threaded end part 16 of the mandrel into the fastener, as illustrated in FIG. 2. The threaded part 16 of the mandrel engages with the threaded first part 33 of the fastener and draws the tool towards the fastener, the operator pushing the tool gently towards the panel 36. The abutment face 14 of the nosepiece then meets the flange 34 of the fastener, and as illustrated in FIG. 3, the nosepiece 13 is thereby caused to be displaced relatively towards the tool body (or rather the tool body is moved forwardly with respect to the nosepiece) and this causes the leadscrew device 31 of the tool to be actuated to stop clockwise rotation of the drawbar and to retract the drawbar rearwardly relative to the tool body. When the drawbar 23 is retracted with respect to the tool body, the mandrel 15 is also retracted by the transmission of the axial thrust from the boss 25, which is secured to the drawbar, to the mandrel 15 through the two aubtting frustoconical faces 27 and 26 respectively. Since the operator is still pressing the tool towards the panel, the abutment face 14 of the nosepiece holds the fastener head flange 34 against the panel, and the pull on the mandrel which is engaged with the threaded first part 33 of the fastener causes the fastener to contract axially by outwards buckling of the intermediate portion 35. This forms an annular bulge or flange in the body of the fastener which, together with the head flange 34, grips the panel 36 securely, thus installing the threaded fastener in the panel. The tool is then disengaged from the placed fastener by reversing the drive to unscrew the mandrel from the fastener.

It should be noted that when the nosepiece is fully displaced in the tool body with the drawbar and mandrel still unretracted (the position shown in FIG. 3), there is still clearance between the rear face of the end wall of the nosepiece and the front of the boss 25.

The permissible movement of the mandrel so that its axis 29 can diverge from alignment with the tool axis 28 allows the tool to be offered up to, and initially engaged with the fastener, with the tool axis slightly out of alignment with the fastener axis as illustrated in FIG. 2. The mandrel can align itself with and threadedly engage the fastener whilst still rotating out of alignment with the tool axis, the hexagonal key 22 and socket 21 acting as a universal joint. The amount of mis-alignment between the axes of the tool and mandrel is limited by the contact of the unthreaded portion 18 of the mandrel with the forward end of the tube 24. Once the mandrel has been screwed sufficiently far into the threaded first part of the fastener, the forward end of the tube 24 enters into the second part of the fastener and brings the axes of the tool and fastener into mutual alignment so that the abutment face 14 of the nosepiece 13 can abut the head 34 squarely.

The tube 24 also performs a second function in that, when the mandrel is retracted with respect to the nosepiece and tool body to collapse the intermediate portion 35 of the fastener as previously described, the presence of the tube 24 inside this portion prevents this portion of the fastener from collapsing inwardly. The tube 24 is also retracted in unison with the mandrel 15, and therefore does not interfere with the pulling of the threaded part 33 of the fastener towards the head flange 34.

In the foregoing embodiment, the auxiliary member was formed as an integral part comprising the tube 24 and the boss 25. In the embodiment illustrated in FIG. 4 which is generally similar to the embodiment of FIGS. 1 to 3 and in which the same reference numerals are used to indicate similar parts, two separate parts are provided to perform the functions performed by the integral tube 24 and boss 25 of the foregoing embodiment. Thus, in this embodiment, a tubular cap 40 is secured to the forward end of the drawbar 23 and holds the head 19 of the mandrel 15 in driven engagement with the forward end of the drawbar. Instead of a hexagonal key and socket arrangement for transmitting rotary drive from the drawbar to the mandrel, as in the previous embodiment, there is provided a key and slot arrangement. Thus, the mandrel head 19 is provided with a diametrical slot 42 in its rear end face and the drawbar is formed integrally with a key 44 which extends diametrically across the forward end face of the drawbar, providing a wide, thin forward projection, analogous to a screwdriver blade, which enters into the slot 42 in the head of the mandrel whereby rotation of the drawbar is transmitted to the mandrel.

The stem 18 of the mandrel projects forwardly through an aperture 45 in the forward end of the cap 40 and forwardly through the annular nosepiece 13 of the tool. The head of the mandrel is a loose fit inside the cap 40 and the cap has a conical face 27 complementary to the conically tapering face 26 of the mandrel head to form a seating through which rearward axial thrust from the drawbar can be transmitted through the cap 40 to the mandrel. As the head of the mandrel is a loose fit within the cap and the key 44 is a loose fit within the slot 42, the mandrel is permitted to move out of alignment with the axis of the drawbar, pivoting about a position located at the slot in the mandrel head.

The auxiliary member in this embodiment is in the form of a sleeve 46 comprising a tube 47 which surrounds the unthreaded part 18 of mandrel clearance, and an external flange 48 at the rearward end of the tube. The tube 47 extends through and is a sliding fit in the annular end wall at the forward end of the nosepiece, and the flange 48 is adapted to abut the internal surface 50 of the end wall so that the sleeve is retained in the nosepiece.

It will be appreciated that the mandrel has some freedom of movement so that its stem can move out of alignment with the tool axis, this freedom of movement being limited by the tube 47 which is located in the annular end wall of the nosepiece.

Figure 4:
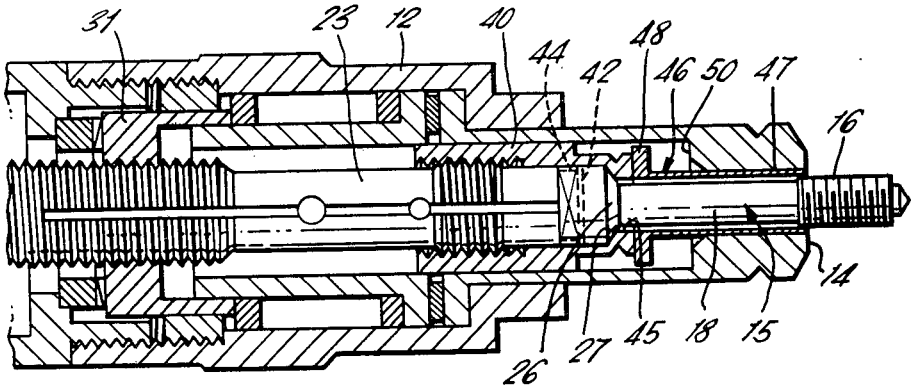
FIG. 4 is a longitudinal axial section through part of a fastener placing tool, illustrating, on a smaller scale than that of FIGS. 1 to 3, another embodiment of the invention.

In FIG. 4, the drawbolt is shown in its most rearward position, the mandrel and sleeve being fully retracted relative to the abutment face of the nosepiece. Before the tool in this condition can be used to place a fastener, it will be necessary to return the drawbolt forwardly by operating the drive in reverse to that used when placing a fastener. When the drawbolt is thus returned to its forward position the mandrel is advanced forwardly so that the stem projects further beyond the abutment face 14. At the same time, the forwrd end of the cap 40 abuts the flange 48 and so the sleeve is pushed forwardly so that the tube 47 also projects forwardly of the abutment face.

In order to place a fastener, the tool is then operated to rotate the mandrel in a sense appropriate to threadedly engage with the threaded portion of the fastener and, as the mandrel progressively enters into the fastener, the tube 47 also progressively enters into the second part of the fastener where it serves to prevent the fastener collapsing inwardly as previously explained.

As in the previous embodiment, progressive entry of the mandrel and tube 47 into the fastener eventually causes the nosepiece of the tool to be displaced rearwardly thereby causing the lead screw device to cease rotating the mandrel and to cause it to retract. The sleeve 46 is pushed rearwardly into the nosepiece by the rearward movement of the first part of the fastener under the influence of the retracting mandrel.

In this embodiment however, the sleeve is floating and is not obliged to rotate with the mandrel as it is in the previous embodiment although it may do so if the rotating mandrel moves sufficiently out of alignment with the tool axis to frictionally engage the sleeve. As the sleeve does not necessarily rotate with the mandrel it will have little tendency to impart rotation with a fastener with which it becomes engaged. This is of advantage during the placing of the fastener and also particularly during removal of the tool from a fastener which due to an error of judgement of the tool operator has not firmly gripped the panel in which it has been placed. In such circumstances it can happen that the friction between the fastener and the tube is greater than that between the fastener and the panel 36. Therefore if the tube were to be positively driven to rotate with the mandrel, difficulty would occur in disengaging the mandrel from the fastener. Thus by arranging that the sleeve is not positively driven to rotate with the mandrel but rather tends to restrain rotation of the fastener, disengagement of the mandrel from the fastener is facilitated.

The fastener placing tool of the foregoing examples is advantageous in that it allows a certain amount of angular mis-alignment between the tool and the fastener, at least in the initial stages.

The invention is not restricted to details of the foregoing example.

I claim:

1. Apparatus for placing a fastener by pulling a threaded first part of the fastener towards and/or into a second part of the fastener, which apparatus comprises abutment means having an abutment face for abutting the second part of the fastener and defining a tool axis at right angles to said abutment face, a threaded mandrel for threadedly engaging the first part of the fastener, and a tubular auxiliary member coaxial with said tool axis and surrounding said mandrel with clearance, said auxiliary member being reciprocable along said tool axis relative to said abutment means and projecting forwardly of said abutment means when at the forward end of its reciprocation, said mandrel being reciprocable and rotatable and having limited freedom to move out of alignment with said tool axis, said freedom to move limited by the auxiliary member.

2. Apparatus for placing a fastener by pulling a threaded first part of the fastener towards and/or into a second part of the fastener, which apparatus comprises a tubular nosepiece providing an annular abutment face for abutting the second part of the fastener and defining a tool axis coaxial with the abutment face and at right angles thereto, a threaded mandrel extending through said abutment face substantially along said tool axis, but having freedom to move out of alignment with said tool axis, said mandrel being rotatable and reciprocable relative to said abutment face, and a tubular auxiliary member surrounding said mandrel with clearance, said auxiliary member being reciprocable along said tool axis relative to the abutment face and projecting forwardly of said abutment face when at the forward end of its reciprocation, said auxiliary member limiting the freedom of movement of the mandrel from alignment with the tool axis.

3. Apparatus according to claim 2, wherein the tubular auxiliary member is reciprocable independently of the mandrel.

4. Apparatus according to claim 3, wherein the tubular auxiliary member is rotatable independently of the mandrel.

5. Apparatus according to claim 2, including drive means for rotating and reciprocating said mandrel, said drive means being reciprocable along and rotatable about said tool axis, and a universal joint arrangement drivingly connecting said drive means to said mandrel whereby said mandrel can be driven to rotate and reciprocate while out of alignment with said tool axis.

6. Apparatus according to claim 5, wherein the tubular auxiliary member is connected to the drive means so as to be rotatable and reciprocable in unison with the mandrel.

7. Apparatus according to claim 2 including a rotary motor and a lead screw device, said lead screw being operable alternately to transmit rotary motion from said motor to said mandrel and to translate rotary motion from said motor into reciprocatory movement of said mandrel.

8. Apparatus for placing in a workpiece a fastener of the type comprising a threaded first part which is pulled towards and/or into a second part to place the fastener, which apparatus comprises:

a body member, a lead-screw device comprising a first element and a second element in threaded engagement with each other, the first element being arranged to be driven to rotate about an axis in a fixed position relative to the body and the second element being rotatable and reciprocable on said axis relative to the body member, a threaded mandrel for threadedly engaging with the threaded first part of a fastener to be placed, a driving connection between the mandrel and the second element of the lead-screw whereby the mandrel may be driven to rotate and reciprocate relative to the body member, said driving connection permitting the mandrel a limited freedom to move out of alignment with the said second element, a first torque-limiting rotary connection between the first and second elements of the lead-screw device, and a second torque-limiting rotary connection between the second element of the lead-screw device and the body member, at least one of the torque-limiting rotary connections being arranged to support a greater torque in one sense of rotation than in the opposite sense, an abutment member for abutting the second part of the fastener when the threaded member is engaged with the first part of the fastener, the abutment member abutting the second part of the fastener when the fastener and the body member are drawn towards each other by rotation of the threaded member in a first sense appropriate to advance the threaded member into the fastener in threaded engagement with the first part thereof, first rotation-stopping means actuated by abutment of the abutment member with the second part of the fastener as aforesaid, to stop rotation of the second element of the lead-screw device relative to the body member so that continued rotation of the first element in said first sense causes longitudinal movement of the second element and the threaded member relative to the body member and the abutment member in a first direction to draw the first and second parts of the fastener towards each other, second rotation-stopping means for stopping relative rotation between the second element and the first element when the first element is rotating in a sense opposite to said first sense and the second element reaches a forward limit of movement in a second direction opposite said first direction, wherein the second torque-limiting rotary connection is in the form of a slipping clutch comprising two relatively rotatable members which are permanently urged into frictional engagement with each other thereby permanently to support a predetermined minimum torque between the second element of the lead-screw device and the body member, and a tubular auxiliary member aligned with the second element of the lead-screw device and surrounding said mandrel with clearance, said auxiliary member being reciprocable along said axis relative to the abutment face and projecting forwardly of said abutment face when at the forward end of its reciprocation, said auxiliary member limiting the freedom of movement of the mandrel from alignment with said axis.

* * * * *